US006301818B1

(12) United States Patent
Hogue

(10) Patent No.: US 6,301,818 B1
(45) Date of Patent: Oct. 16, 2001

(54) SYNTHETIC GRIP FOR A HANDGUN HANDLE AND METHOD OF INSTALLATION

(76) Inventor: Patrick L. Hogue, P.O. Box 1138, Paso Robles, CA (US) 93447

( * ) Notice: Subject to any disclaimer, the term of this patent is extended or adjusted under 35 U.S.C. 154(b) by 0 days.

(21) Appl. No.: 09/513,989

(22) Filed: Mar. 6, 2000

(51) Int. Cl.[7] ..... F41C 23/00
(52) U.S. Cl. ..... 42/71.02
(58) Field of Search ..... 42/71.02, 74, 106; 89/1.1, 1.42

(56) References Cited

U.S. PATENT DOCUMENTS

| | | | | |
|---|---|---|---|---|
| 3,683,535 | * | 8/1972 | Lewis | 42/71.02 |
| 4,199,887 | * | 4/1980 | Hogue | 42/71.02 |
| 4,878,304 | * | 11/1989 | Cup | 42/71.02 |
| 4,936,036 | * | 6/1990 | Sniazak et al. | 42/71.02 |
| 6,112,446 | * | 9/2000 | Forster et al. | 42/71.02 |

* cited by examiner

*Primary Examiner*—Charles T. Jordan
*Assistant Examiner*—Elizabeth Shaw
(74) *Attorney, Agent, or Firm*—Charles C. Logan, II

(57) ABSTRACT

A synthetic grip for a handgun (specifically a revolver) that does not require any separate attaching components. The grip is attached to the handle frame by engaging the existing frame stock pin with the grip's own spring tension resiliency. The grip has a U-shaped molded assembly having a front wall portion and two side wall portions extending rearwardly from the outer edges of the front wall portion for engaging the side walls of the handle frame. Each side wall portion has a groove in its inner surface extending substantially from its top end to its bottom end thereby forming a track for receiving the opposite ends of the stock pin extending outwardly from the side walls of the handle frame. Adjacent the bottom end of each of the grooves is a recess that captures the ends of the stock pin. The grip is preferably made from a hard plastic U-shaped core member that has been overmolded with a resilient layer of plastic material.

12 Claims, 2 Drawing Sheets

SYNTHETIC GRIP FOR A HANDGUN HANDLE AND METHOD OF INSTALLATION

BACKGROUND OF THE INVENTION

The invention relates to a hand grip and more specifically to a hand grip for a handgun.

The present invention is specifically for use with a type of handgun commonly known as a revolver. It has been a trend in recent years to make revolvers lighter in weight and to this end many firearm manufacturers are offering many revolvers constructed from lightweight alloys and titanium. Substantial emphasis has been given to weight reduction in the gun itself, but the grip has been largely ignored. Conventional wisdom dictates that the revolver grip is to be held on the handle frame by screw or other attachment devices. The principal object of the present invention is to eliminate all unnecessary weight by eliminating all separate attachment hardware and maximizing the use of lightweight materials and construction.

The only prior art patent known to the inventor that uses an integral grip made from a resilient, flexible, synthetic plastic material is illustrated in Sniezak et al U.S. Pat No. 4,936,036. This handgrip still requires a pin 58 fitted through aligned bores in his grip and pin 58 serves to fasten the grip onto the handle of the handgun.

It is an object of the invention to provide a novel grip for a handgun that does not require any separate attachment hardware.

It is also an object of the invention to provide a novel grip for a handgun made entirely of lightweight plastic material.

It is another object of the invention to provide a novel grip for a handgun that has a U-shaped hard plastic molded core having an over molded layer of resilient plastic material.

It is a further object of the invention to provide a novel grip for a handgun that is economical to manufacture and market.

It is an additional object of the invention to provide a novel grip for a handgun that is easily and quickly attached or detached from the handle frame of a handgun such as a revolver.

SUMMARY OF THE INVENTION

The present invention is a grip for a revolver style handgun that has been molded from a stiff but resiliently flexible material. The grip has a U-shaped configuration such that the grip fits over the opposite ends of the stock pin extending outwardly from both lateral side walls of the handle frame. The U-shaped molded assembly has a front wall portion for engaging the front wall of a handgun handle and two sidewall portions extending rearwardly from the outer edges of the front wall portion for engaging the side walls of the handgun handle.

There is a groove on the inner surface of each of the side wall portions that extends substantially from its top end to its bottom end forming a track for receiving the opposite ends of the stock pin extending outwardly from the side walls of the handle frame of the handgun. A recess is formed in the bottom end of each of these grooves for capturing the respective opposite ends of the stock pin. The grip retains its position over the stock pin by the natural material tension of the grip exerting a clamping force toward the handle frame. The grip is further designed with compressible rubber bumpers in the loop area of the handle frame allowing the grip to be pre-loaded between the stock pin and the loop area in the fully installed position on the revolver. The pre-load prevents any shifting or rocking movement of the grip and compensates for any gun frame dimension variation.

DESCRIPTION OF THE PREFERRED EMBODIMENT

Figure 2:
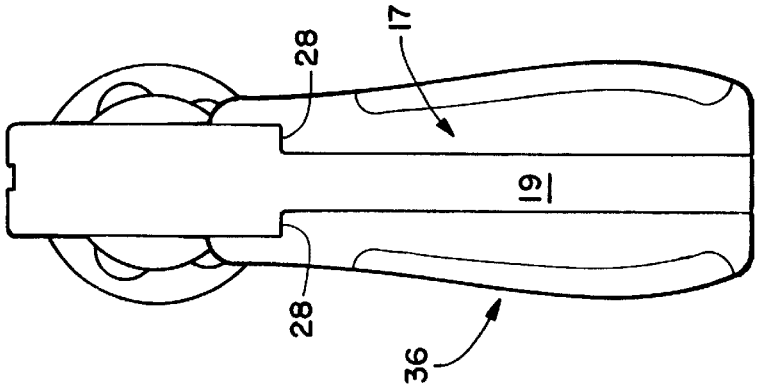
FIG. 2 is a rear elevation taken along lines 2—2 of FIG. 1.
Figure 1:
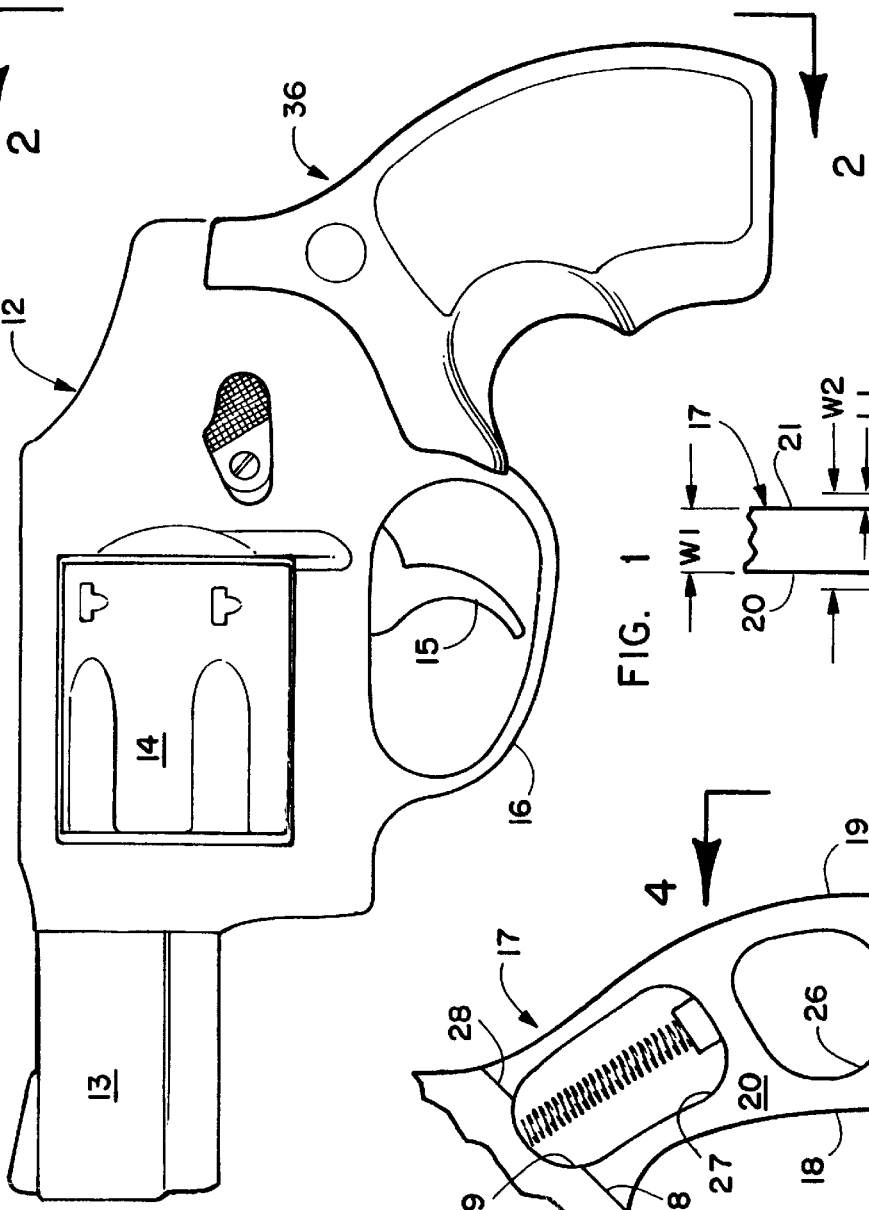
FIG. 1 is a left side elevation view of a revolver with if the novel grip mounted on its handle frame.
Figure 4:
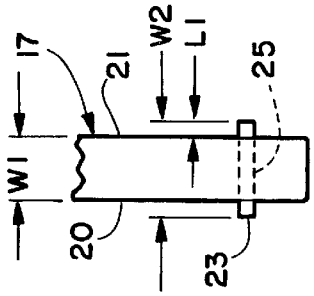
FIG. 4 is a partial rear elevation view taken along lines 4—4 of FIG. 3.
Figure 3:
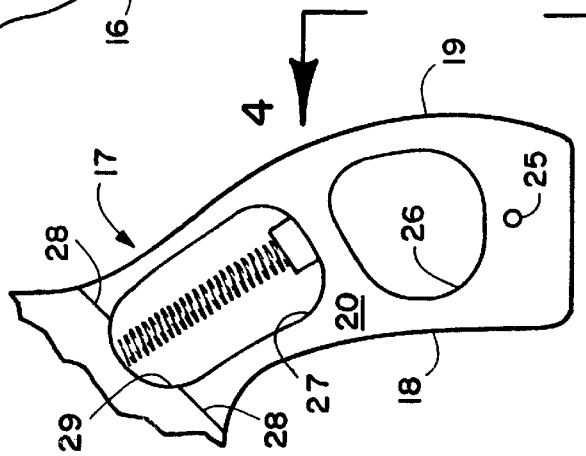
FIG. 3 is a partial left side elevation view of the handle frame of the revolver.

The novel synthetic grip for a handgun will now be described by referring to FIGS. 1–10 of the drawings. In FIGS. 1 and 2, the grip 36 is illustrated as installed on a revolver 12 having a barrel 13, a cylinder 14, a trigger 15, a trigger guard 16 and a handle frame 17.

Handle frame 17 has a front wall 18, a rear wall 19, and laterally spaced side walls 20 and 21. Handle frame 17 has a width W1. A stock pin 23 extends through a bore hole 25. Stock pin 23 extends a distance L1 outwardly from the respective side walls 20 and 21. Cutouts 26 and 27 are also formed in handle frame 17. The upper portion of cutout 27 has a curved surface known as the looped area 29. Shoulders 28 extend outwardly from the respective side walls 20 and 21 to provide an abutment surface for synthetic grip 30. Stock pin 23 has a width W2.

Figure 7:
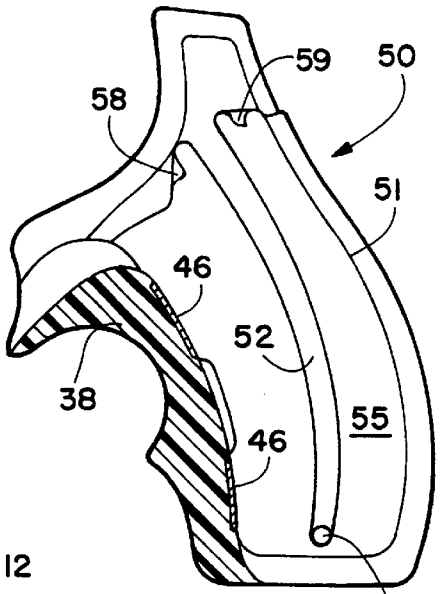
FIG. 7 is a vertical cross sectional view showing the inner surface of the right side wall portion of the synthetic grip.
Figure 6:
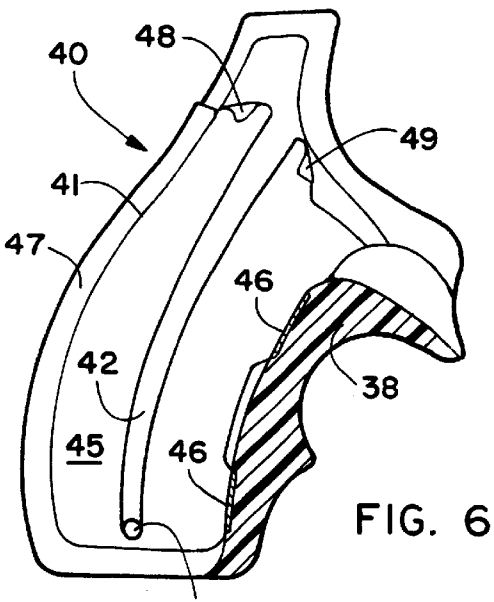
FIG. 6 is a vertical cross sectional view showing the inner surface of the left side wall portion of the synthetic grip.
Figure 10:
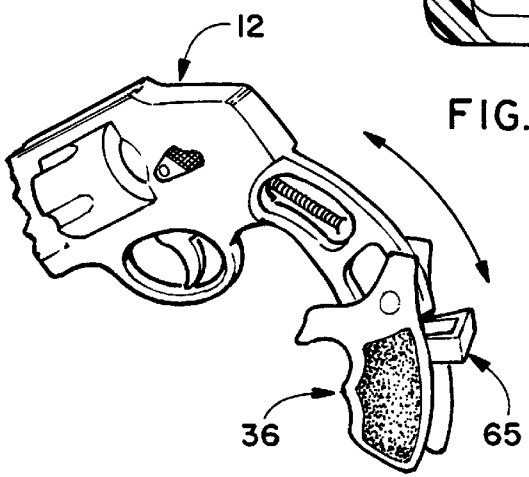
FIG. 10 is a partial side elevation view illustrating the manner in which the handle frame of the revolver is inserted into the interior of the synthetic grip once the side wall portions have been spread a predetermined amount.
Figure 5:
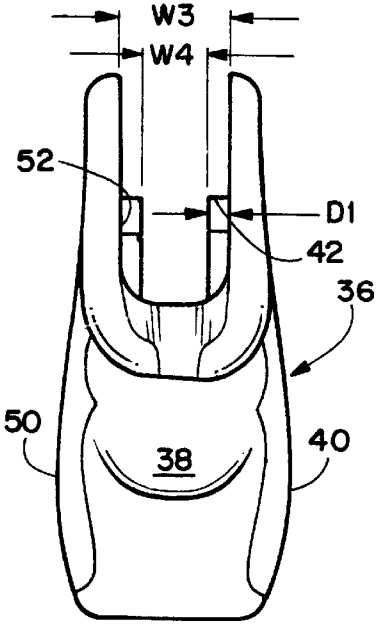
FIG. 5 is a front elevation view of the novel synthetic grip.

The structure of synthetic grip 36 is best understood by referring to FIGS. 5–7. Synthetic grip 36 has a front wall portion 38, a left side wall portion 40 and a right side wall portion 50. Left side wall portion 40 has an inner surface 41 having a groove 42 extending substantially from its top end to its bottom end. A recess 43 is formed adjacent the bottom end of groove 42. A hard plastic core member having a Rockwell hardness in the range of 80–120 on the Rockwell R scale has a left side wall 45, a right side wall 55 and a front wall 46. A resilient plastic layer 47 covers the outer surface of the U-shaped core member. Compressible rubber bumpers 48 and 49 are part of resilient layer 47.

Right side wall portion 50 has an inner wall surface 51, that has a groove 52 extending substantially from its top end to its bottom end. A recess 53 is formed in groove 52 adjacent its bottom end. The U-shaped core member has a right side wall 55 that is connected to front wall 46. Right side wall 55 is covered by the layer of resilient plastic material 47. Compressible rubber bumpers 58 and 59 are a part of resilient layer 47.

Figure 9:
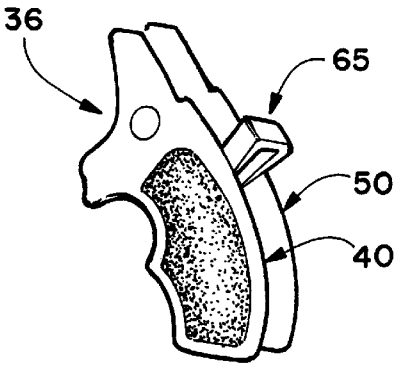
FIG. 9 is a rear perspective view of the synthetic grip with the bantam wedge tool spreading the opening between the laterally spaced side wall portions of the synthetic handgrip.
Figure 8:
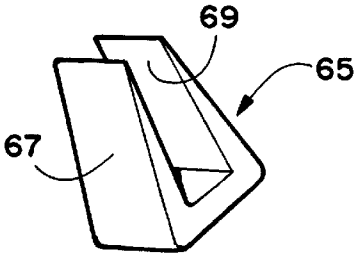
FIG. 8 is a front perspective view of the bantam wedge tool used during installation of the synthetic grip on the handle frame of the revolver.

A bantam wedge tool 65 is illustrated in FIG. 8. It is formed of a hard plastic material and has a pair of rigid legs 67 and 69. In FIG. 9, bantam wedge tool 65 has been inserted between the inner surfaces of left side wall portion 40 and right side wall portion 50 that normally have a width between their surfaces of W4. The distance between the bottom surface of the respective grooves 42 and 52 is W3 and that is less than the length of stock pin 23 whose length is W2. As bantam wedge 65 is pushed further inwardly between the respective left and right side wall portions 40 and 50, these members will spread to a width W2 that is at least as great as the length of stock pin 23. At this point, the bottom end of handle frame 17 is inserted between the respective left and right side wall portions 40 and 50 of the synthetic grip and the ends of stock pin 23 can enter in the respective grooves 42 and 52. Then with a radial motion, the grip is slid onto the handle frame and the bantam wedge tool 65 is removed. The synthetic grip is continually slid onto the handle frame until the opposite ends of stock pin 23 snaps into the corresponding recesses or stock pin holes 43 and 53. The grip is now in place and will not come off with normal use.

What is claimed is:

1. A synthetic grip for a handgun handle having a front wall and laterally spaced side walls comprising:

a U-shaped molded assembly of resilient plastic material including a front wall portion for engaging the front wall of a handgun handle and two side wall portions extending rearwardly from the outer edges of said front wall for engaging the side walls of a handgun handle;

each of said side wall portions having a top end, a bottom end, an outer surface and an inner surface; a groove in said inner surface of each of said side wall portions extending substantially from said top ends to said bottom ends forming a track for receiving the opposite ends of a stock pin extending outwardly from the side walls of a handgun handle.

2. A synthetic grip for a handgun as recited in claim 1 wherein said grip is for a gun handle having a width W1 and the internal width between said inner surfaces of said side wall portions is W4 and W4 is substantially equal to W1.

3. A synthetic grip for a handgun as recited in claim 1 wherein the depth D1 of said grooves is less than the length L1 that a stock pin extends from the side wall of a handgun handle.

4. A synthetic grip for a handgun as recited in claim 1 wherein in said inner surface of said side wall portions have a top end and a bottom end and said groove has a curvature substantially from said top end to said bottom end.

5. A synthetic grip for a handgun as recited in claim 1 wherein said groove in said inner surface of said sidewall portions have a top end and a bottom end and a recess is formed in said grooves adjacent said bottom ends for capturing the stock pin of the handle of a handgun.

6. A synthetic grip for a handgun as recited in claim 1 wherein said grooves in said inner surface of said side wall portions have a top end and a bottom end and said groove have a tapered width from said top end to said bottom end.

7. A synthetic grip for a handgun as recited in claim 1 wherein said grooves in said inner surface of said side wall portions have a top end and a bottom end and said grooves have a tapered depth from said top end to said bottom end.

8. A synthetic grip for a handgun as recited in claim 1 wherein said grooves in said inner surface of said side wall portions have a top end and a bottom end and said bottom end is closed.

9. A synthetic grip for a handgun as recited in claim 1 wherein said U-shaped molded assembly is formed of a hard U-shaped plastic core having an outer surface and an inner surface; said inner surface of said core forms said inner surface of said side wall portions; a resilient plastic layer is overmolded said outer surface of said U-shaped plastic core.

10. A synthetic grip for a handgun as recited in claim 1 further comprising a compressible rubber bumper on each lateral side of said grooves adjacent said top ends of said respective side wall portions; said rubber bumpers function to pre-load said grip on the handle of a handgun and prevents any shifting or rocking movement of said grip.

11. A method of installing a synthetic grip on the handle of a handgun wherein said handle has a stock pin extending from the lateral sides of said handle; said synthetic grip having a U-shaped molded assembly of resilient plastic material including a front wall portion for engaging the front wall of a handgun handle and two side wall portions extending rearwardly from the outer edges of said front wall for engaging the side walls of a handgun handle; said side wall portions each having an inner surface having a groove extending substantially from said top end of said side wall portions to said bottom end of said side wall portions thereby forming a track for receiving the opposite ends of said stock pin extending outwardly from said side walls of said handgun handle; said method comprising the following steps;

a) taking a wedged shaped tool and spreading said side wall portions apart a predetermined width;

b) inserting the opposite ends of said stock pin in said top ends of said respective grooves on said inner surface of said side wall portions of said synthetic grip;

c) sliding said synthetic grip onto said handle of said handgun until said stock pin snaps into the corresponding internal stock pin holes in said grooves adjacent said bottom ends of said grooves.

12. A method of installing a synthetic grip on the handle of a handgun wherein said handle has a stock pin extending from the lateral sides of said handle; said synthetic grip having a U-shaped molded assembly of resilient plastic material including a front wall portion for engaging the front wall of a handgun handle and two side wall portions extending rearwardly from the outer edges of said front wall for engaging the side walls of a handgun handle; said side wall portions each having an inner surface having a groove extending substantially from said top end of said side wall portions to said bottom end of said side wall portions thereby forming a track for receiving the opposite ends of said stock pin extending outwardly from said side walls of said handgun handle; said method comprising the following steps;

a) spreading said side wall portions apart a predetermined width;

b) inserting the opposite ends of said stock pin in said top ends of said respective grooves on said inner surface of said side wall portions of said synthetic grip;

c) sliding said synthetic grip onto said handle of said handgun until said stock pin snaps into the corresponding internal stock pin holes in said grooves adjacent said bottom ends of said grooves.

* * * * *